US005494006A

United States Patent [19]

Davis, Jr.

[11] Patent Number: 5,494,006

[45] Date of Patent: Feb. 27, 1996

[54] ROTATING DEBRIS SCREEN FOR INTERNAL COMBUSTION ENGINES

[76] Inventor: Robert D. Davis, Jr., 627 Andrew, Jackson, Mich. 49202

[21] Appl. No.: 401,868

[22] Filed: Mar. 10, 1995

[51] Int. Cl.[6] ..... F01P 7/10

[52] U.S. Cl. ..... 123/41.49; 123/198 E

[58] Field of Search ..... 123/198 E, 41.49; 180/68.6; 416/247 R; 55/351, 385.3, 400, 471

[56] References Cited

U.S. PATENT DOCUMENTS 3,630,003 12/1971 Ashton et al. ..... 123/41.33

4,589,379 5/1986 Fujikawa et al. ..... 123/41.49

5,046,458 9/1991 Kronich ..... 55/400

*Primary Examiner*—Noah P. Kamen

*Attorney, Agent, or Firm*—James M. Deimen

[57] ABSTRACT

A dirt and debris screen for liquid cooled internal combustion engines comprises a disc or shallow formed cup of perforated mesh attached to the fan hub or fan shaft just upstream of the radiator and fan. Rotating at fan speed dirt and debris collected by the disc is centrifugally ejected from the edge of the disc and thereby prevented from entering the air passages through the radiator. The centrifugal ejection also makes the disc substantially self-cleaning.

4 Claims, 2 Drawing Sheets

ROTATING DEBRIS SCREEN FOR INTERNAL COMBUSTION ENGINES

BACKGROUND OF THE INVENTION

The field of the invention pertains to liquid cooled internal combustion engines having radiators and fans to force air through the radiators. In particular, the invention pertains to engines that are subjected to dirt and debris in the fan air stream. Applications of such engines to commercial lawn mowers and street sweepers result in significant quantities of dirt and debris blown by the radiator fan into the radiator. Within a relatively short period of use the cooling capacity of the radiator can be significantly impaired by dirt laden and clogged air passages through the radiator.

Commercial lawn mowers and street sweepers are frequently used in very hot and dry weather. Therefore, the cooling capacity of the radiator is frequently used dose to the design limit. Significant amounts of dirt and debris trapped in the radiator can cause engine overheating with loss of power and a substantially shortened engine life. Dirt and debris laden air may also cause decreased radiator cooling capacity in certain industrial processing applications and open pit mining applications of the engines whether stationary or on specialized vehicles.

Stationary grillwork and screening has been used to surround and protect radiators from flying debris. However, such screening does not inhibit dust from collecting in radiator passages. In some applications shrouds have been used with grillwork to control the air stream flow path. Such shrouds reduce easy access for repair or servicing. In other applications extensive duct work has been used to raise the inlet to the fan well above most of the debris floating in the air. Such approaches are considerably expensive or otherwise impractical for many applications.

Some air cooled internal combustion engines have been equipped with a rotating dirt and debris screen mounted on the engine crank shaft adjacent the flywheel, fan and magneto, alternator or dynamo combination. In such applications, the grillwork and shrouding of the engine remains necessary for safety reasons and to properly direct airflow about the engine cooling fins.

SUMMARY OF THE INVENTION

Liquid cooled engines with external fans and radiators have not adopted the rotating screen concept. However, because of the dirty environmental conditions that liquid cooled engine commercial lawn mowers and street sweepers are almost continuously exposed to, there exists an advantage to a rotating means of preventing debris from reaching the radiator.

The invention comprises a disc of open mesh screen mounted on the fan shaft for the radiator. The disc may be mounted in front of or behind the fan blades relative to the air flow, however, the preferable location is in front of the fan blades to prevent debris from adhering to the blades.

The mesh size is sufficiently fine to prevent substantially all debris that could otherwise accumulate in the radiator from reaching the radiator but course enough to keep air flow restriction to a minimum. The screen disc rotates at fan speed thereby causing debris caught by the disc to be spun off centrifugally to the side of the disc and fan.

A flat or formed perforated mesh disc is believed most energy efficient at high engine and fan speeds, however, expanded metal or some other very inexpensive mesh might be selected. The ratio of open area to solid area of the disc should be as great as possible allowing for necessary stiffness of the disc to assure maximum air flow through the disc.

DESCRIPTION OF THE PREFERRED EMBODIMENTS

Figure 1:
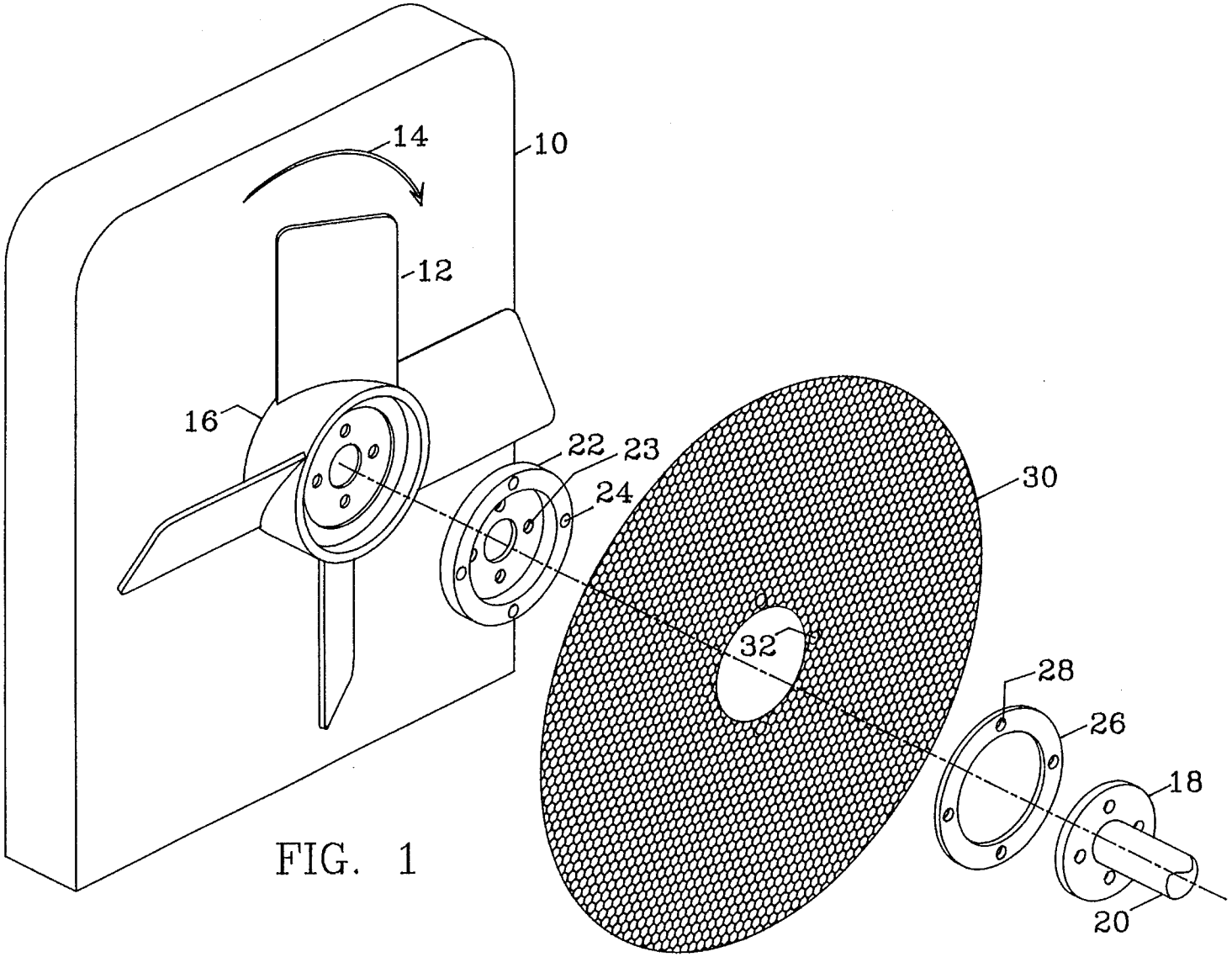
FIG. 1 illustrates in exploded view a mesh screen disc attached to a radiator fan.

Illustrated in FIG. 1 is a radiator 10 in outline and a fan 12 positioned to blow air with positive pressure through the radiator by rotating in the direction of arrow 14. The fan 12 hub 16 is bolted to a flange 18 on the end of a shaft 20. The shaft 20 may be directly connected to the engine crankshaft or indirectly driven by a belt and pulleys in the most common applications to liquid cooled engines. Or the shaft 20 and fan 12 may be driven by a separate electric, hydraulic or pneumatic motor.

Affixed to the hub 16 and flange 18 therebetween is a collar 22 with a plurality of inner holes 23 for attachment to the hub 16 and flange 18. Circumferential attachment means 24 such as threaded holes are located about the collar 22 at a greater diameter than the attachment means of the hub 16, collar 22 and flange 18. The circumferential attachment means 24 also includes a ring 26 with holes 28 for machine screws or bolts, to attach a perforated mesh disc 30 to the fan 12. Thus, air drawn through the fan 12 first passes through the mesh disc 30. Dirt and debris caught on the mesh disc 30 is generally thrown to the side by centrifugal force as the disc rotates at high speed.

The mesh disc 30 includes holes 32 for the screws or bolts around a central opening 38 in the disc to accommodate the shaft 20. Alternatively, the mesh disc 30 and ring 26 may be riveted or welded to the collar 22. Although shown in FIG. 1 as a flat disc 30, the disc alternatively may be formed with annular or radial ribs to increase the surface area of the disc 30 and thereby increase the available flow area for air to pass through the disc. The ribs also stiffen the disc 30 without substantially adding to the weight or manufacturing cost. Most important is the lack of interference of the ribs with the radial movement of debris as the disc 30 rotates at fan speed. The self-cleaning nature of the disc 30 eliminates the need to stop the engine for frequent cleaning of the disc. Thus, any annular ribs formed in the disc 30 must not be abrupt in the radial direction.

Figure 2:
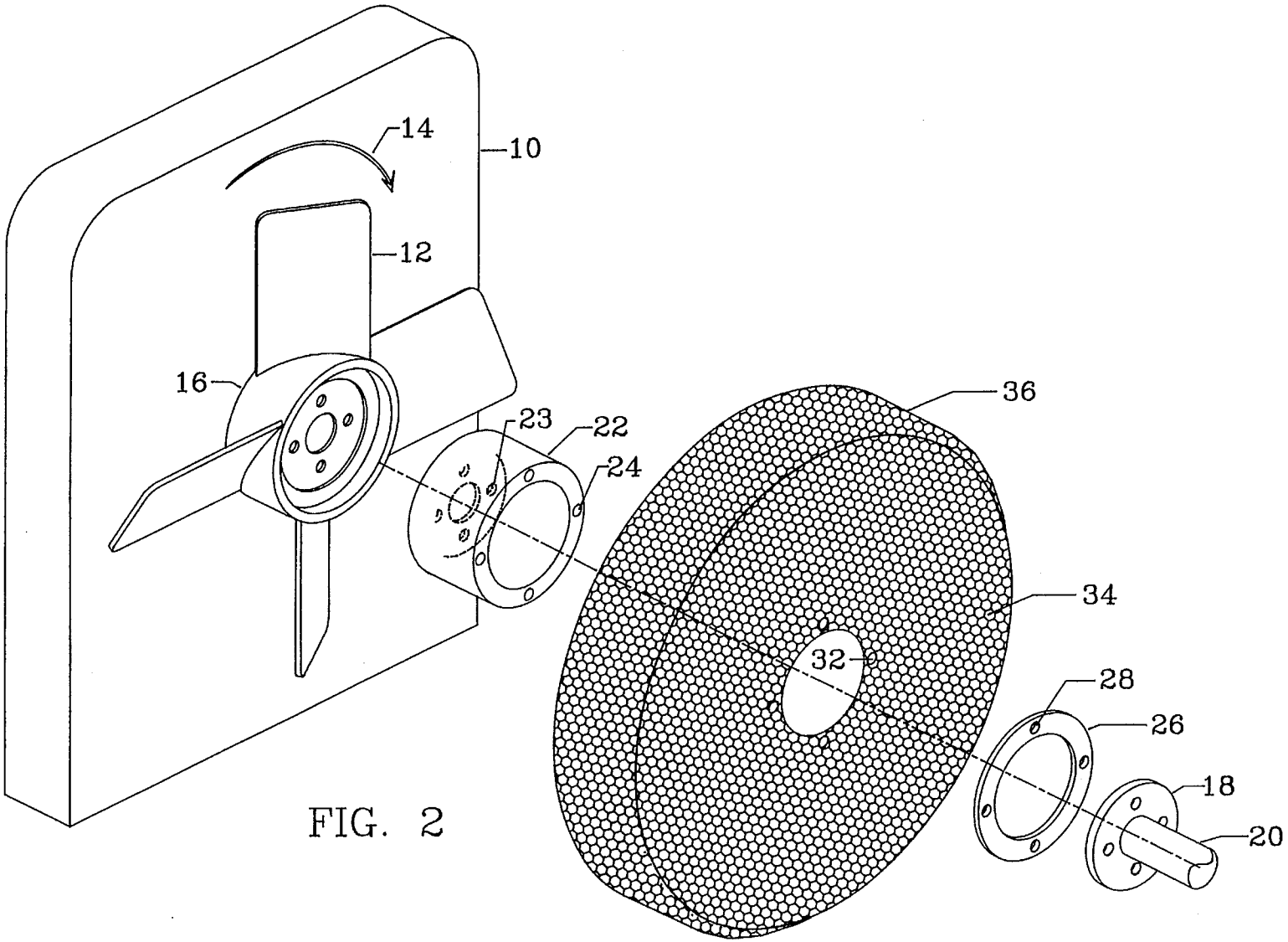
FIG. 2 illustrates a cupped screen disc formed to create added flow area through the perforated screen disc.

In FIG. 2 a modified screen 34 is formed to a shallow cup shape by bending the periphery 36 over as shown. Thus, a larger screen 34 with greater flow area can be positioned in the same diametral area as the screen disc of FIG. 1.

I claim:

1. In combination with a liquid cooled engine having a radiator and a fan, the fan mounted on a rotatable shaft and being positioned to blow air through the radiator, a self-cleaning debris screen comprising a circular perforated mesh disc having a mesh size sufficient to substantially prevent debris from passing therethrough and means adjacent the center of the mesh disc to attach the mesh disc to the shaft for rotation with the shaft and fan.

2. The engine and debri screen combination of claim 1 including means to increase the surface and flow area of the disc without increasing the diameter of the disc.

3. The engine and debris screen combination of claim 1 wherein the periphery of the perforated mesh disc is bent over in the downstream direction of air flow.

4. The engine and debris screen combination of claim 1 including a central hole through the debris screen.

* * * * *